US008028929B2

(12) United States Patent
Lehtonen

(10) Patent No.: US 8,028,929 B2
(45) Date of Patent: Oct. 4, 2011

(54) ARRANGEMENT IN FUEL SUPPLY APPARATUS

(75) Inventor: Kai Lehtonen, Vaasa (FI)

(73) Assignee: Wärtsilä Finland Oy, Vaasa (FI)

( * ) Notice: Subject to any disclaimer, the term of this patent is extended or adjusted under 35 U.S.C. 154(b) by 1416 days.

(21) Appl. No.: 10/555,483

(22) PCT Filed: Jun. 11, 2004

(86) PCT No.: PCT/FI2004/050090

§ 371 (c)(1),
(2), (4) Date: Nov. 2, 2005

(87) PCT Pub. No.: WO2004/111440

PCT Pub. Date: Dec. 23, 2004

(65) Prior Publication Data

US 2006/0278730 A1 Dec. 14, 2006

(30) Foreign Application Priority Data

Jun. 17, 2003 (FI) ..... 20030912

(51) Int. Cl.

| | |
|---|---|
| ***F02M 47/02*** | (2006.01) |
| *F02M 59/00* | (2006.01) |
| *F02M 61/00* | (2006.01) |
| *F02M 63/00* | (2006.01) |

(52) U.S. Cl. ..... 239/88; 239/90; 239/533.2; 239/533.5

(58) Field of Classification Search ..... 239/88–91, 239/533.1–533.4, 585.1, 102.1; 251/129.15, 251/129.21; 123/496, 446, 447

See application file for complete search history.

(56) References Cited

U.S. PATENT DOCUMENTS

| | | | | |
|---|---|---|---|---|
| 5,056,488 | A * | 10/1991 | Eckert | 123/446 |
| 5,215,113 | A * | 6/1993 | Terry | 137/460 |
| 6,085,990 | A * | 7/2000 | Augustin | 239/88 |
| 6,244,253 | B1 | 6/2001 | Haeberer et al. | |
| 6,581,850 | B1 * | 6/2003 | Boecking et al. | 239/102.2 |

(Continued)

FOREIGN PATENT DOCUMENTS

DE 19602906 7/1997

(Continued)

OTHER PUBLICATIONS

Kuni Sasaki, Office action for JP 2006-516246, Jul. 23, 2009 (English Translation).

(Continued)

*Primary Examiner* — Len Tran
*Assistant Examiner* — James S Hogan
(74) *Attorney, Agent, or Firm* — Chernoff, Vilhauer, McClung & Stenzel

(57) ABSTRACT

An arrangement for controlling the fuel supply in a fuel supply apparatus, which arrangement comprises a body part including a space, through which the fuel to be injected flows during the operation, and a fuel inlet opening and a fuel discharge opening, which open into said space, the arrangement further comprising a piston member movably arranged in said space and a flow path to provide flow communication between the fuel inlet opening and the fuel discharge opening. The arrangement comprises at least one throttle section opening to the front of the piston member in the flow direction of the fuel, the cross-sectional flow area of which section is determined by the mutual positions of the piston member and the body part.

10 Claims, 6 Drawing Sheets

U.S. PATENT DOCUMENTS

Figure 1:
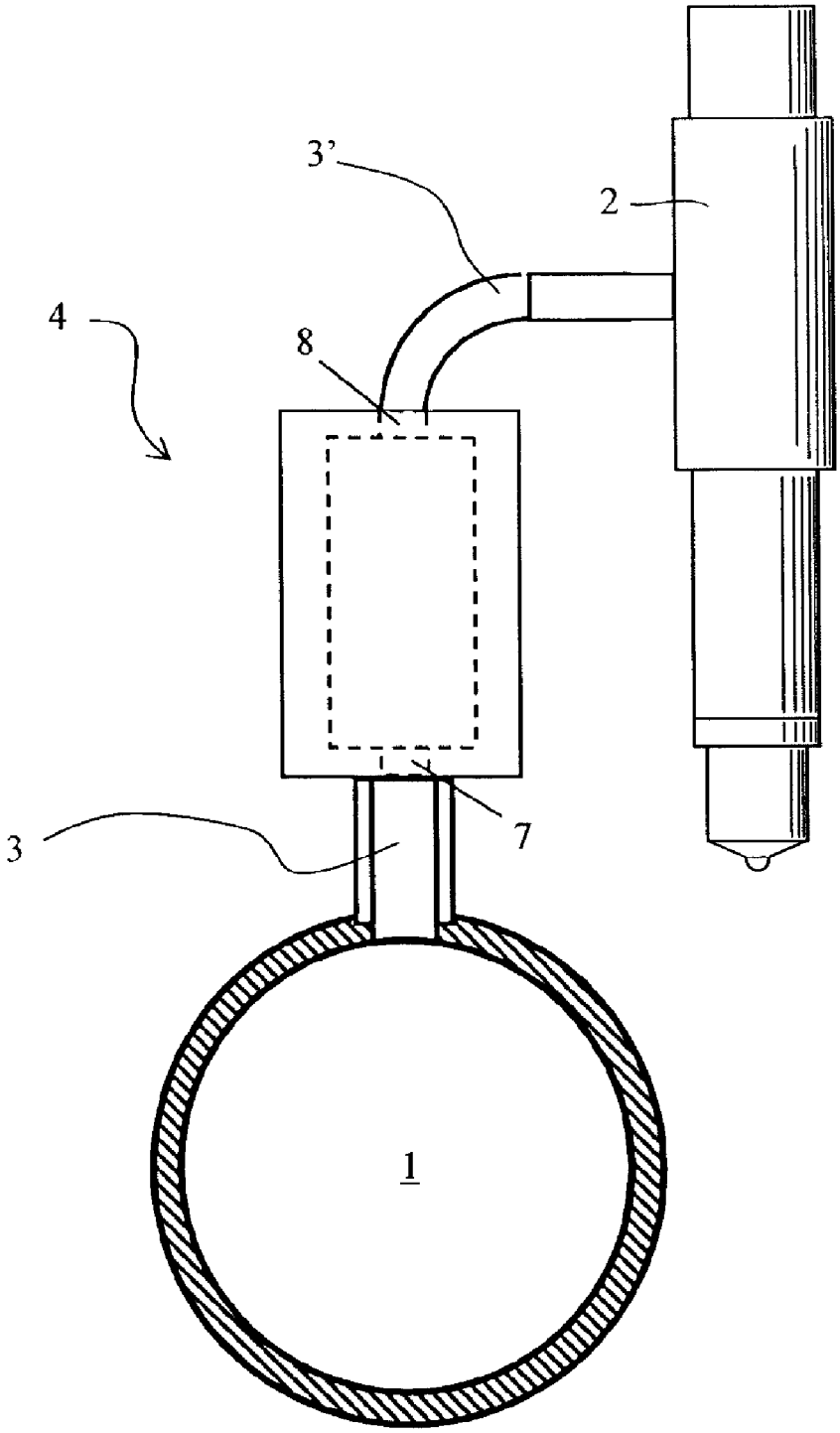

| | | | | |
|---|---|---|---|---|
| 6,889,659 | B2 * | 5/2005 | Magel | 123/446 |
| 6,915,785 | B2 * | 7/2005 | Eisenmenger et al. | 123/446 |
| 7,083,113 | B2 * | 8/2006 | Kropp et al. | 239/92 |
| 7,188,782 | B2 * | 3/2007 | Magel | 239/96 |

FOREIGN PATENT DOCUMENTS

| | | |
|---|---|---|
| DE | 19640085 | 4/1998 |
| GB | 2317922 | 4/1998 |
| JP | 2002515565 T | 5/2002 |
| JP | 2003161232 | 6/2003 |
| WO | 95/17594 | 6/1995 |
| WO | 9960266 | 11/1999 |

OTHER PUBLICATIONS

Abstract of DE 19822671 (related to JP 2002515565), esp@cenet database, accessed Nov. 11, 2009.

Han, Joon Sup, Office action for KR 1020057024276, Mar. 28, 2011 (English Translation).

* cited by examiner

ARRANGEMENT IN FUEL SUPPLY APPARATUS

This is a national stage application filed under 35 USC 371 based on International Application No. PCT/FI2004/050090 filed Jun. 11, 2004, and claims priority under 35 USC 119 of Finnish Patent Application No. 20030912 filed Jun. 17, 2003.

The invention relates to an arrangement in a fuel supply apparatus in accordance with the preamble of claim 1.

Common rail storage injection systems utilizing pressure accumulators are generally used in conjunction with piston engines. In such systems fuel stored in a so-called pressure accumulator is injected at injection pressure into the combustion space of the engine by controlling an injection valve.

A flow fuse is generally used as a safety device in fuel injection apparatuses. The flow fuse is usually disposed between the pressure accumulator and the injection valve. The flow fuse blocks the flow path out of the accumulator in the event that leaks occur and the injection valve should e.g. remain stuck in the open position, whereby an uncontrolled fuel leakage to the combustion space of the cylinder may take place. To prevent this, the patent specifications U.S. Pat. No. 3,780,716 and WO 95/17594 disclose a flow fuse limiting the fuel flow rate. The flow fuse has typically a cylinder space, which includes further a piston member provided with spring loading acting against the flow direction of the fuel during the injection. In normal operation the fuel quantity required for each injection correlates with the volume displaced by the piston travel. Should the injection valve for some reason continue to leak, the piston will travel to its other extreme position, where it shuts off the flow.

In a typical common rail storage system the injection pressure reaches a high pressure level almost immediately after the needle of the injection nozzle has opened. Consequently, when fuel is injected into the combustion space its mass flow rate is extremely high from the very beginning of the injection. In this case the pressure in the combustion space of the engine may rise too fast for achieving an optimum performance.

An object of the present invention is therefore to provide an arrangement in a fuel supply apparatus, where the disadvantages related to prior art are minimized. Especially an aim of the present invention is to provide an arrangement, by which the mass flow rate of fuel can be limited in the beginning of the injection.

The objects of the invention are met substantially as is disclosed in the claim 1 and as is more clearly disclosed in the other claims.

The arrangement for controlling the fuel supply in a fuel supply apparatus comprises a body part including a space, through which the fuel to be injected flows during the operation, and a fuel inlet opening and a fuel discharge opening, which open to said space. Moreover, the arrangement comprises a piston member movably disposed in said space, and a flow path to provide flow communication between the fuel inlet opening and the fuel discharge opening. The arrangement comprises at least one throttle section opening to the front of the piston member in the flow direction of the fuel, the cross-sectional flow area of which section is determined by the mutual positions of the piston member and the body part.

According to one embodiment the throttle section comprises several openings arranged in the piston member at various points in the direction of its longitudinal axis and/or an opening extending in the direction of its longitudinal axis. Thus, the piston member comprises a passage, which extends a distance from its end facing the fuel inlet opening in the longitudinal direction of the piston, which distance is longer than the length of the piston member portion having a smaller diameter. There are channels arranged to extend from the passage, which channels are substantially transverse with respect to its direction and open to the outer surface of the portion of the piston member having a smaller diameter.

According to another embodiment the throttle section comprises several openings arranged in the body part at various points in the direction of the longitudinal axis of the piston and/or at least one oblong opening arranged in the body part in the direction of its longitudinal axis. Preferably, the openings are arranged at regular intervals on the periphery of the body part.

The body part comprises an outer part and an inner part, between which a space enabling fuel flow communication between the openings and the fuel inlet opening is disposed. The inner part consists of a cylindrical portion and a bottom portion arranged at one end of the cylindrical portion, and the bottom portion is provided with at least one groove, which extends to the outer surface of the inner part of the cylindrical portion. Preferably, the openings are arranged in the cylindrical portion of the inner part.

By the arrangement according to the invention it is possible to limit the mass flow rate of the fuel to be injected in the beginning of the injection, however, providing an adequate injection pressure during the actual injection. In addition, the solution according to the invention makes it possible to shut off the fuel flow from the injection nozzle in the event of failure.

In the following the invention is described by way of example with reference to the attached schematic drawings, in which

Figure 2:
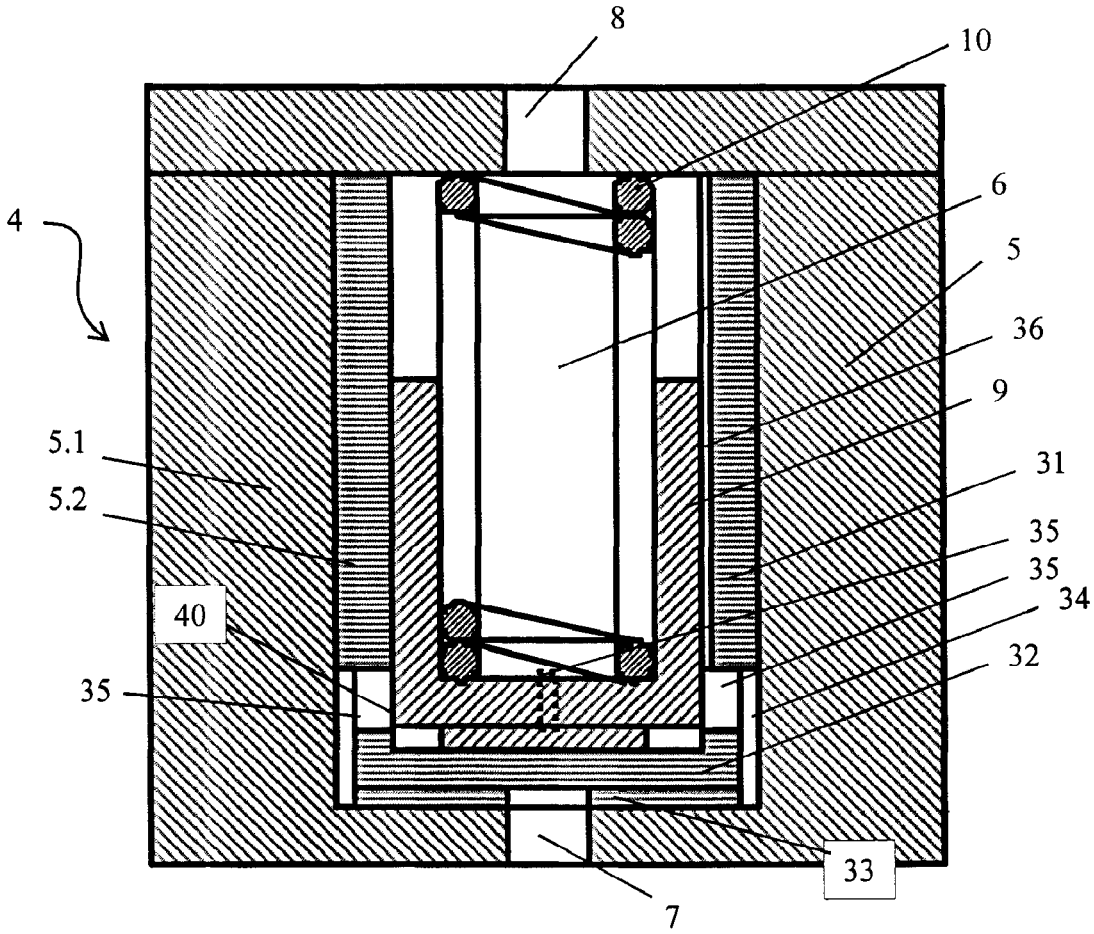
Figure 3:
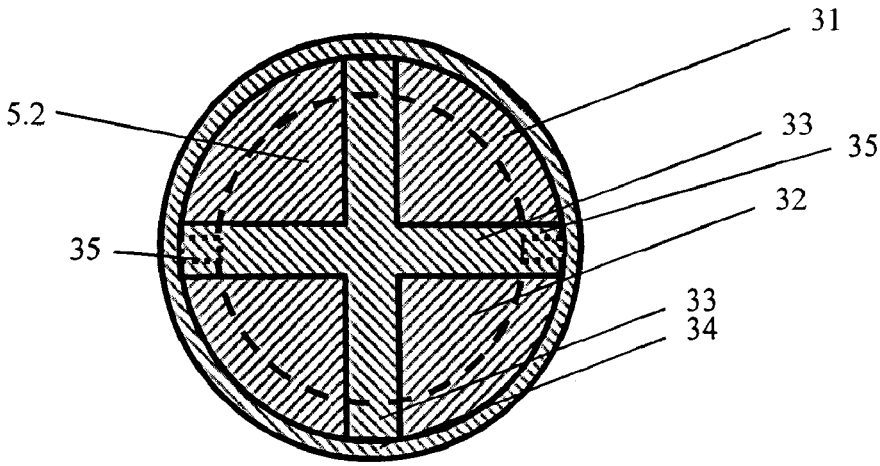
Figure 4:
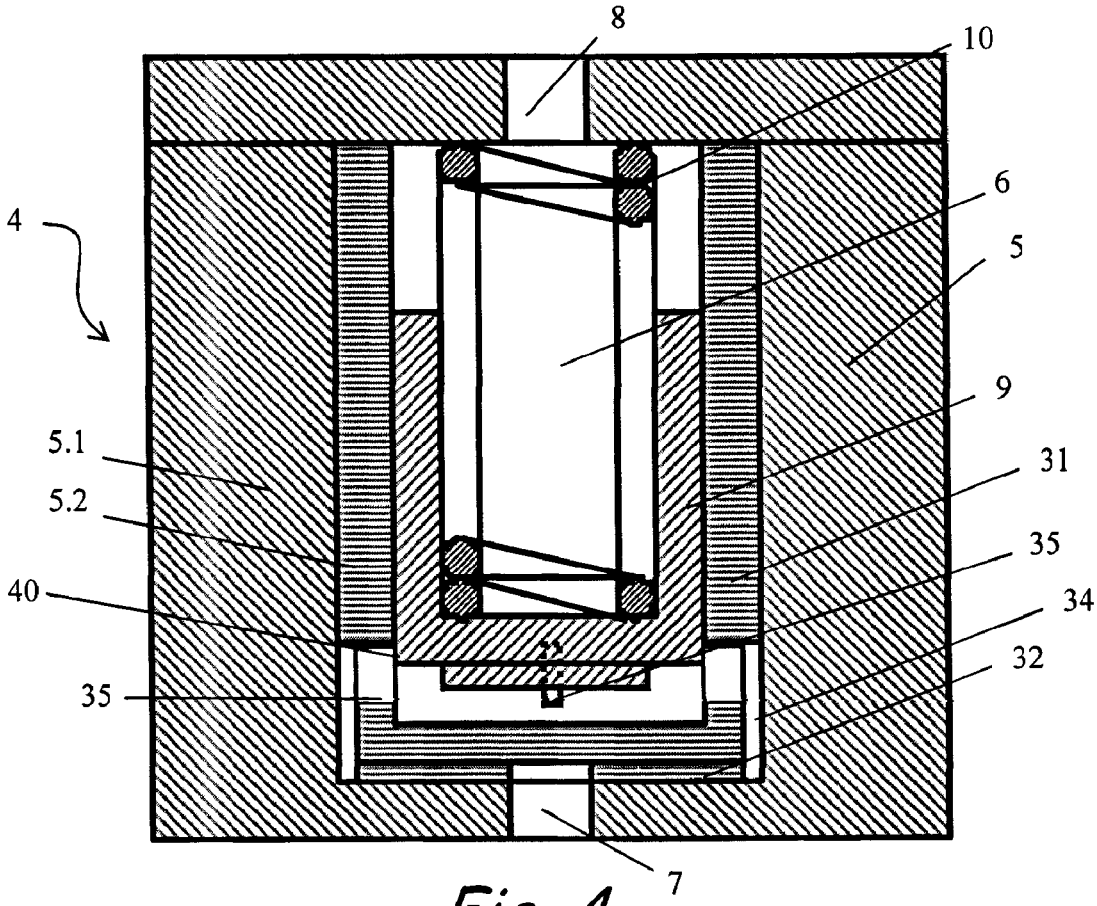
Figure 5:
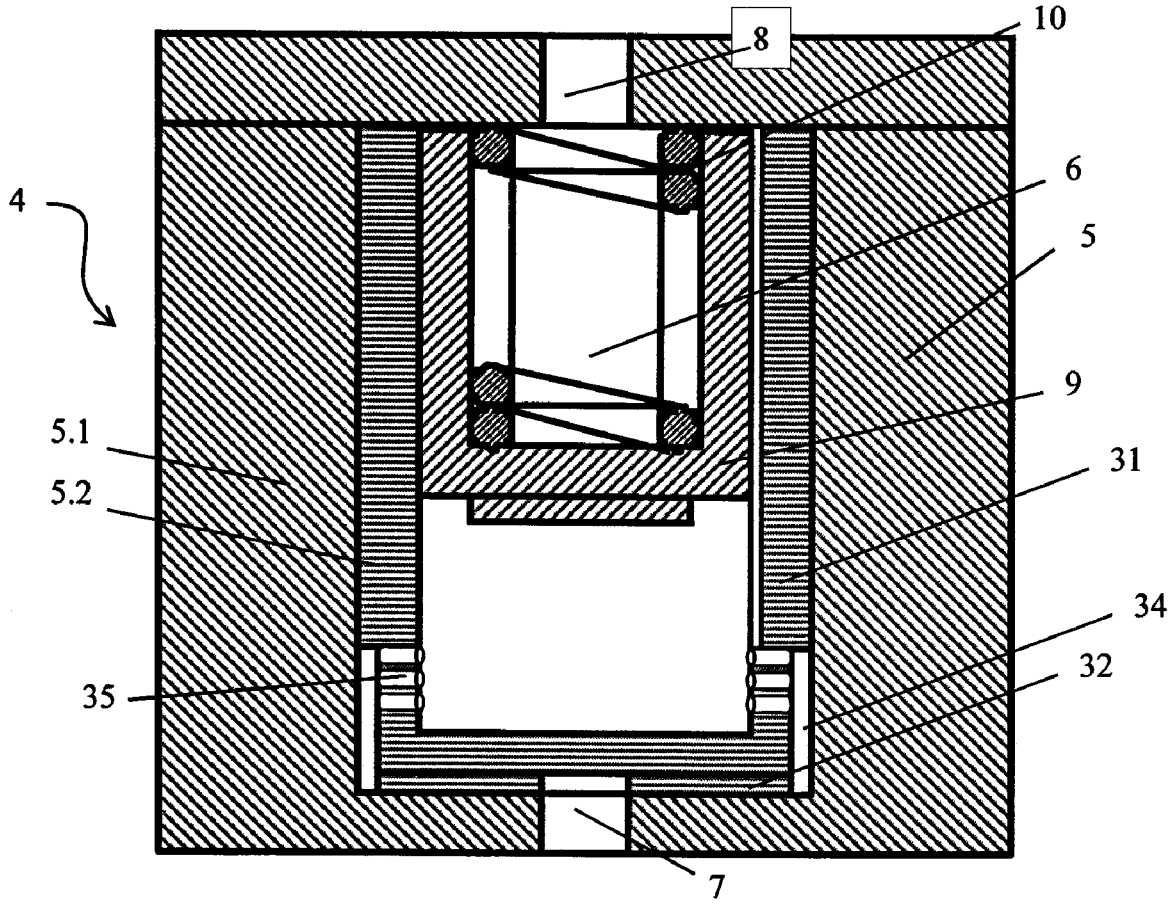
Figure 6:
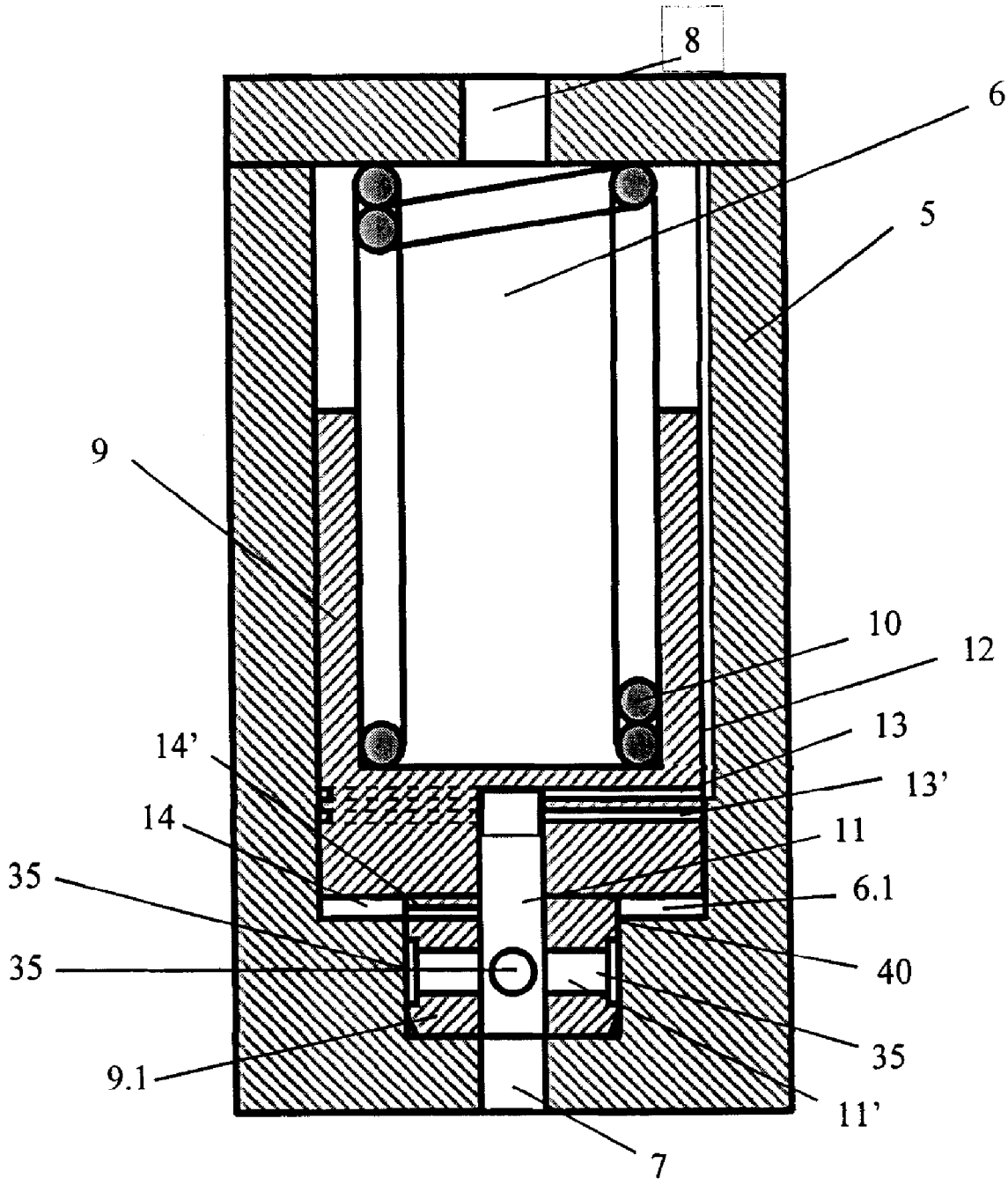
Figure 7:
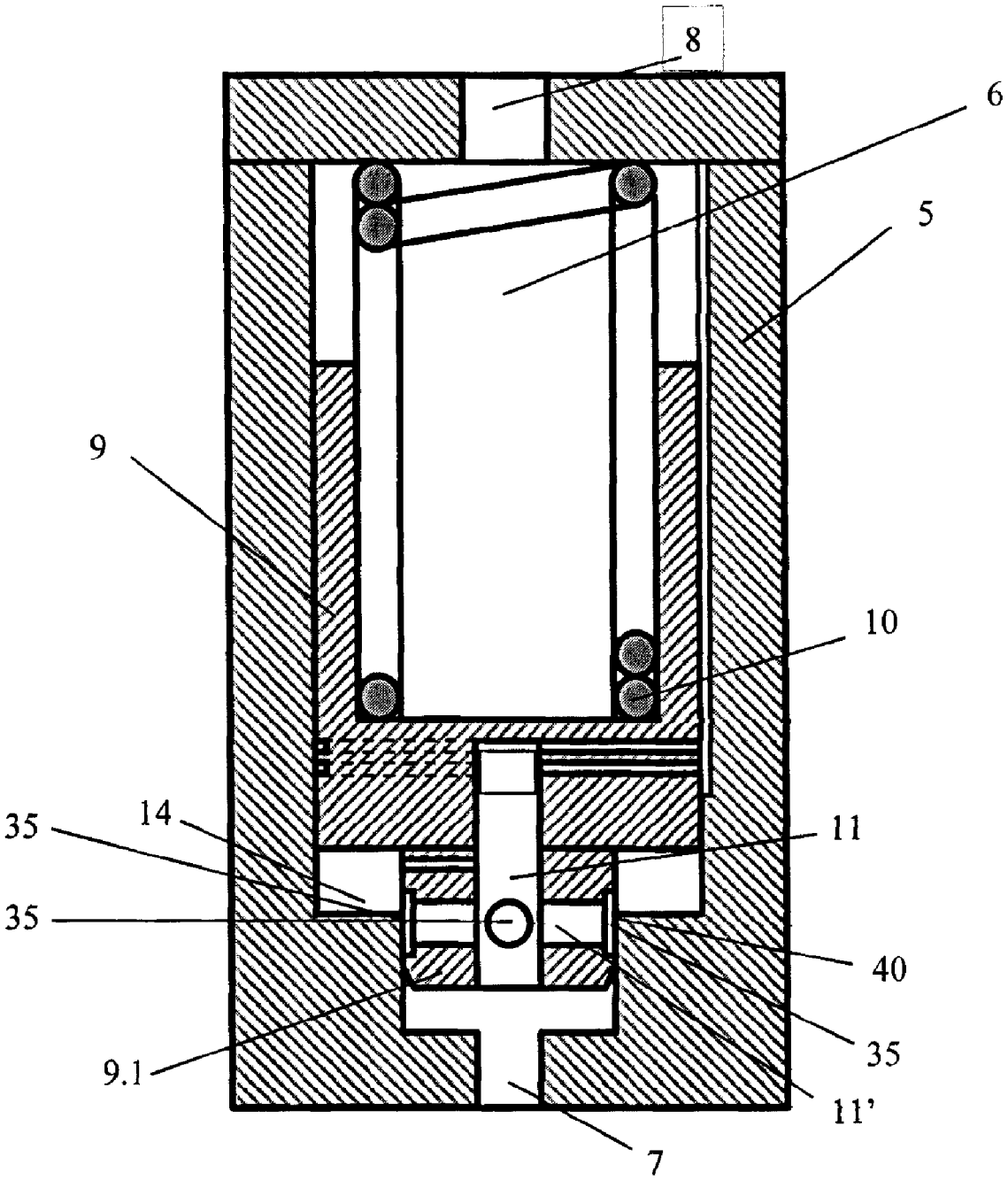

- FIG. 1 shows how the arrangement according to the invention is applied to a fuel injection system in an engine;
- FIG. 2 shows one embodiment of the arrangement according to the invention;
- FIG. 3 shows the inner part of the body part in the arrangement according to FIG. 2;
- FIG. 4 shows the arrangement according to FIG. 2 in its initial state;
- FIG. 5 shows the arrangement according to FIG. 2 in its other extreme state;
- FIG. 6 shows another arrangement according to the invention in its initial state; and
- FIG. 7 shows the arrangement according to FIG. 6 in another state.

The aim has been to use a consistent reference numbering system in the figures as far as it has been possible from the viewpoint of keeping the specification explicit. All parts possibly included in the practical application of the arrangement have not necessarily been described or disclosed herein, as the disclosure of those parts has not been necessary for the understanding of the invention.

FIG. 1 depicts very schematically how the arrangement 4 according to the invention can be disposed in conjunction with a fuel injection system based on common rail storage. This kind of fuel injection system is as such known from prior art, and it is described here only as far as it is essential for the operation of the invention. The main component in the fuel injection system based on common rail storage is a common rail storage, i.e. a pressure accumulator, in which fuel at high pressure is stored before it is injected into an engine, and with which an injection valve 2 is in flow communication. A fuel channel system 3, 3' is arranged to extend from the common rail storage 1 to the injection valve 2 dosing fuel to each cylinder (not shown). Under the operation such pressure is maintained in the common rail storage that a sufficient injection pressure can be provided for the injection valve 2. Each injection valve 2 comprises control members (not shown) for controlling the injection independently. The fuel channel system 3, 3' is provided with an arrangement 4 according to the invention, the operation of which is described in the following with reference to FIGS. 2-7.

FIG. 2 shows an advantageous embodiment of the arrangement 4 according to the invention for controlling the fuel supply in a fuel supply apparatus. The arrangement comprises a body part 5, in which a space 6 is arranged. While the engine is running, the fuel flows through this space 6. In space 6 there is also a piston member 9, which is arranged movably against the force provided by a spring 10. The spring 10 is dimensioned so that it is able to return the piston member 9 to its initial position fast enough after the injection. A fuel inlet opening 7 and a fuel discharge opening 8 located on different sides of the piston member 9, respectively, are also in flow communication with space 6. A fuel flow path is, however, provided between the inlet opening 7 and the discharge opening 8 by the combined effect of various channels and spaces.

The body part of the arrangement according to FIG. 2 consists of an outer part 5.1 and an inner part 5.2. The outer part 5.1 is provided with said fuel inlet and discharge opening 7, 8. Inside the outer part there is a space, where the inner part 5.2 is accommodated. The inner part is arranged immovably in the space inside the outer part and its purpose is by means of its shape and the grooves and/or holes arranged therein to form a part of the fuel flow path. This kind of solution is advantageous as the spaces, channels etc., which are essential for the operation of the arrangement can be provided, when required, by measures taken in both the outer part 5.1 and the inner part 5.2 and by the combined effect of these measures, whereby machining or similar operations performed separately in these parts are relatively simple.

The inner part 5.2 is shown in FIG. 3 seen from the direction of the fuel inlet opening 7. The inner part consists of a cylindrical portion 31 and a bottom portion 32 arranged at one end of the cylindrical portion. In this case the bottom portion is provided with two intersecting grooves 33, which extend over the shell of the inner part 5.2. These grooves form a part of the fuel flow path from the inlet opening 7 forward. The bottom portion and the shell of the inner part 5.2 in the vicinity thereof have a smaller diameter than the rest. In this manner a space 34 is formed between the outer part 5.1 and the inner part 5.2, which space forms also a part of the fuel flow path from the grooves 33 forward. The cylindrical portion 31 is provided with openings 35, which form a part of the flow path as well. In this embodiment two oblong openings are shown, but their shape and quantity are always chosen compatible with the application. In this manner fuel is allowed to flow via the grooves 33 in the inner part 5.2 and the space 34 to the openings 35, and further to the front of the piston member 9 seen from the flow direction of the fuel.

The situation before the injection is shown in FIG. 2. Here the piston member 9 is in its initial position at the end adjacent to the inlet opening 7. Thus the piston member 9 covers all the openings 35 more or less completely. When the injection valve 2 is opened, the fuel pressure in the section adjacent to the discharge opening 8 falls and the piston member 9 starts travelling. As the piston member 9 travels further, an increasing part of the openings 35 become open and at the same time the cross-sectional area of the fuel flow path expands. Then fuel may flow via the constantly increasing area of the openings 35 to the front of the piston and speed up the piston travel toward the fuel discharge opening 8. Thus, the basic idea is to restrict the effect of the fuel pressure on the piston member in the beginning of the injection and thereby restrict the rise of the injection pressure.

The situation at the start of an injection is shown in FIG. 4. The piston member divides the space 6 into sections facing the inlet opening 7 and the discharge opening 8, respectively. In this situation a control edge 40 formed by the piston member 9 together with the openings 35 form a throttle in the fuel flow path, which opens into the section in space 6 facing the inlet opening of the body part, in which throttle the throttling effect is dependent on the positions of the piston member in the body part 5. In the beginning of the injection the cross-sectional area of the openings is very small, whereby the throttling effect they provide limits the mass flow rate of the fuel to a considerable extent. While the piston member moves, an increasing part of the area of the openings 35 becomes open and the area of the throttle in the flow path increases, whereby an increased volume of fuel is allowed to flow to the front of the piston member. Due to this the fuel pressure in the section of space 6 facing the inlet opening rises and the speed of the piston travel increases. Thus the fuel quantity during each injection correlates with the volume displaced by the piston travel in space 6. While the piston member travels, also the injection pressure, i.e. the fuel pressure, adjacent to the discharge opening rises. The area of the openings 35 has been chosen so that at least at the end of the injection it will not limit the fuel flow to a large extent, in other words the pressure loss will be small.

Should the injection fuel rate for some reason become excessive, the piston member 9 will travel to its other extreme position, where it shuts off the fuel flow through the discharge opening 8. This situation is shown in FIG. 5. FIG. 5 shows by way of example also another alternative shape of the openings 35. Here the throttle consists of several openings 35 having a circular cross-section, such as bores, arranged in the body part at various points in the direction of its longitudinal axis.

FIG. 6 shows another embodiment of the arrangement according to the invention. Its operational principle is partly the same as the one of the embodiment in FIG. 2. The openings 35 of the throttle portion are, instead of the body part 5, arranged in the piston member 9. The piston member 9 further comprises at its end facing the inlet opening 7 a section 9.1, where its diameter is smaller than the diameter of the rest of the piston. Similarly, space 6 comprises a section, where its diameter is the same as that of the piston member section 9.1. The piston member 9 is provided with a passage 11 in the direction of its longitudinal axis, which passage is in communication with the inlet opening 7 and extends to a distance from the piston member end facing the inlet opening. In the section 9.1 of the piston member 9 there are preferably transverse channels 11' deviating from the direction of the passage 11 and extending from the passage 11 to the outer surface of the section 9.1 of the piston member 9 forming openings 35, which in the situation shown in FIG. 6 are closed by the body part.

Also a channel 14' is arranged to extend from the passage 11 in order to connect the passage 11 with space 14, which is formed between the piston member and the body part at the initial stage of the injection. Space 14 is formed due to the fact that the length of the piston member section 9.1 having a smaller diameter is longer than the space allocated to it in the body part 5.

In addition, the passage 11 is by means of transverse channels 13 and 13' in communication with an expansion 12 formed in the body part, by the combined effect of which the piston member 9 can be returned to its initial position after the injection, i.e. fuel may flow along this path past the piston member, while it travels toward the inlet opening 7. As the channels 13 and 13' are arranged at different points in the longitudinal direction of the piston, the flow communication is first shut off via one channel 13', which decreases the cross-sectional flow area. This slows down the return motion of the piston member at the very final stage.

In the beginning of the injection the fuel pressure in the section of space 6 facing the discharge opening 8 falls and the piston member starts travelling toward the discharge opening 8. Consequently, the volume of space 14 starts increasing and the pressure of the fuel therein falls as well. Then, fuel may flow through channel 14' and passage 11 into space 14. Channel 14' is dimensioned so that the fuel flow to space 14 is to some extent throttled, whereby the speed of the piston member 9 travel can be slowed down in the beginning of the injection, which also slows down the fuel pressure rise at the discharge opening 8, and thus also at the injection valve 2. This stage continues until the openings 35 reach the control edge 40, which is formed in the body part at the point where its diameter changes.

A situation, where the openings 35 have partly passed the control edge 40, whereby a part of their cross-sectional area has opened into space 14, is shown in FIG. 7. While the piston travels further, a still greater part the area of the openings 35 becomes open, whereby the fuel pressure prevailing at the inlet opening 7 is to an increasing extent effective also in space 14. Here, the control edge 40 formed by the body part 5 together with the openings 35 form a throttle 35, 40, which opens into the front of the piston member 9 in the fuel flow direction, the cross-sectional flow area in which throttle is determined by the mutual positions of the piston member 9 and the body part 5.

The throttle in the flow path makes the pressure, which speeds up the piston travel in space 14, rise concurrently with the increasing of the open area of the openings 35 in space 14. Then also the pressure prevailing at the inlet opening 7 gradually starts affecting a larger piston member area, which contributes to the increase of the piston speed. Thus the throttle in the flow path affects here the rise of the fuel pressure, which prevails adjacent to the inlet opening making the piston member travel, in front of the piston in the flow direction of the fuel. The invention is not limited to the above-described applications, but several other modifications are conceivable in the scope of the appended claims. For instance different piston member geometries may be applicable.

The invention claimed is:

1. An arrangement for controlling the fuel supply in a fuel supply apparatus, which arrangement comprises:

a body part defining a space through which fuel to be injected flows during operation, and also defining a fuel inlet opening and a fuel discharge opening, which open into said space, and a piston member movably disposed in said space and having a front face oriented towards the fuel inlet opening, wherein the arrangement defines a flow path to provide flow communication between the fuel inlet opening and the fuel discharge opening, the flow path includes at least one throttle section between the inlet opening and the front face of the piston member in the flow direction of the fuel, the throttle section is formed by at least one opening in the body part, and the body part comprises an outer part and an inner part bounding therebetween a space enabling fuel flow communication between the at least one opening that forms the throttle section and the fuel inlet opening, and the cross-sectional flow area of the throttle section depends on the mutual positions of the piston member and the body part.

2. An arrangement according to claim 1, wherein the inner part of the body part comprises a cylindrical portion and a bottom portion arranged at one end of the cylindrical portion, and the bottom portion is formed with at least one groove, which extends to an outer surface of the inner part.

3. An arrangement according to claim 1, wherein the openings that form the throttle section are formed in the cylindrical portion of the inner part of the body part.

4. An arrangement according to claim 1, wherein the openings that form the throttle section are spaced apart at regular intervals about the periphery of the body part.

5. An arrangement according to claim 1, wherein the openings that form the throttle section are spaced apart longitudinally of the piston member.

6. An arrangement according to claim 1, wherein the at least one opening forming the throttle section comprises an opening having a greater extent parallel to a longitudinal axis of the piston member than perpendicular to said longitudinal axis.

7. An arrangement according to claim 1, wherein the at least one opening forming the throttle section comprises a plurality of openings in the body part.

8. An arrangement according to claim 7, wherein said plurality of openings forming the throttle section are spaced apart longitudinally of the piston member.

9. An arrangement according to claim 1, wherein the at least one opening forming the throttle section comprises a plurality of openings in the body part, said openings being spaced apart at regular intervals about the periphery of the body part.

10. A common rail fuel supply system comprising:

a pressure accumulator, a fuel injection valve, and an arrangement according to claim 1, for controlling supply of fuel from the pressure accumulator to the fuel injection valve, wherein the space defined by the body part is connected to the pressure accumulator and the fuel injection valve via the fuel inlet opening and the fuel discharge opening respectively.

* * * * *